US007739755B2

(12) United States Patent
Taras

(10) Patent No.: US 7,739,755 B2
(45) Date of Patent: Jun. 22, 2010

(54) SPIT CUP

(76) Inventor: John S. Taras, 8324 N. Water Tower Rd., Saginaw, TX (US) 76179

( * ) Notice: Subject to any disclaimer, the term of this patent is extended or adjusted under 35 U.S.C. 154(b) by 558 days.

(21) Appl. No.: 11/757,611

(22) Filed: Jun. 4, 2007

(65) Prior Publication Data

US 2008/0295235 A1 Dec. 4, 2008

(51) Int. Cl.
*A61J 19/00* (2006.01)

(52) U.S. Cl. ..... 4/271; 4/285; 4/258

(58) Field of Classification Search ..... 4/258–260, 4/267, 271, 272, 274, 285; 220/810–812, 220/827, 830, 254.5, 254.3, 254.1, 326, 324, 220/264, 835, 259.1, 908.1
See application file for complete search history.

(56) References Cited

U.S. PATENT DOCUMENTS 3,798,682 A 3/1974 Harreld
4,162,547 A 7/1979 Jenkins
4,908,882 A 3/1990 Williams et al.
5,385,259 A * 1/1995 Bernstein et al. ..... 220/495.11
5,921,425 A * 7/1999 Markey ..... 220/254.4
2006/0101564 A1 * 5/2006 Powdermaker ..... 4/259

* cited by examiner

*Primary Examiner*—Khoa D Huynh
*Assistant Examiner*—Janie Christiansen
(74) *Attorney, Agent, or Firm*—Dale J. Ream

(57) ABSTRACT

A spit cup includes a cap housing defining an interior area. The spit cup further includes a plurality of disposable liners, at least one disposable liner being removably positioned in the interior area to receive a user's spit. A lid is selectively coupled to the cup housing. The lid includes a stationary portion and a flap that is pivotally coupled to the stationary portion and movable between an open position providing access to the interior area and a closed position preventing access thereto. The lid includes a spring for biasing the flap toward the open position. The lid further includes a catch operatively coupled to the stationary portion and being movable between a first configuration in which the catch interacts with the flap and maintains the flap at the closed position and a second configuration in which the catch allows the flap to move to the open position.

15 Claims, 5 Drawing Sheets

SPIT CUP

BACKGROUND OF THE INVENTION

This invention relates generally to liquid receptacles and, more particularly, to a receptacle or spittoon for collecting spittle produced by a person chewing tobacco.

It is well known that a person who chews tobacco needs to spit rather than to swallow the juices that build up in the person's mouth. Otherwise, the person may become nauseated. Many people who chew tobacco do so both outdoors where they may spit on the ground but also indoors where there is not a convenient and sanitary place to spit.

Various devices have been proposed in the art for collecting spittle from a person who is chewing tobacco indoors and needs a place to spit. Specifically, there are devices or proposals for receptacles or spittoons that collect a person's spit in a sanitary manner. Although assumably effective for their intended purposes, the existing devices may be accidentally spilled, may be inadvertently mistaken for a beverage container which may lead to accidental ingestion.

Therefore, it would be desirable to have a receptacle or spittoon that is reusable to collect an amount of spittle and to provide for easy containment. Further, it would be desirable to minimize the chances of spilling collected spittle and to make the process of collection and disposal more efficient. In addition, it would be desirable to have a receptacle that substantially contains the odor of collected spit.

SUMMARY OF THE INVENTION

Accordingly, a spit cup according to the present invention includes a cap housing defining an interior area. The spit cup further includes a plurality of disposable liners, at least one disposable liner being removably positioned in the interior area to receive a user's spit. A lid is selectively coupled to the cup housing. The lid includes a stationary portion and a flap that is pivotally coupled to the stationary portion and movable between an open position providing access to the interior area and a closed position preventing access to the interior area. The lid includes a spring for biasing the flap toward the open position. The lid further includes a catch operatively coupled to the stationary portion and being movable between a first configuration in which the catch interacts with the flap and maintains the flap at the closed position and a second configuration in which the catch allows the flap to move to the open position.

The lid also includes a slider operatively coupled to the catch. The slider is biased to a ready configuration by at least one spring. The slider is movable between the ready configuration and a use configuration. In addition, applying a force to an end of the slider moves the slider from the ready configuration to the use configuration. The slider maintains the catch at the first configuration when the slider is at the ready configuration, and the slider maintains the catch at the second configuration when the slider is at the use configuration.

Therefore, a general object of this invention is to provide a spit cup for collecting spittle produced by a person chewing tobacco.

Another object of this invention is to provide a spit cup, as aforesaid, that is reusable to collect an amount of spittle.

Still another object of this invention is to provide a spit cup, as aforesaid, having a construction that minimizes the chances of spilling collected spittle.

Yet another object of this invention is to provide a spit cup, as aforesaid, that makes the process of collecting and disposing of spit more efficient.

A further object of this invention is to provide a spit cup, as aforesaid, that contains the odor of collected spit.

A still further object of this invention is to provide a spit cup, as aforesaid, that is easy to use and cost effective to produce.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

A spit cup 100 according to the present invention will now be described in detail with reference to FIGS. 1 through 5*b* of the accompanying drawings. More particularly, a spit cup 100 according to the current invention includes a cup housing 110, a liner 120, and a lid 130.

Figure 2:
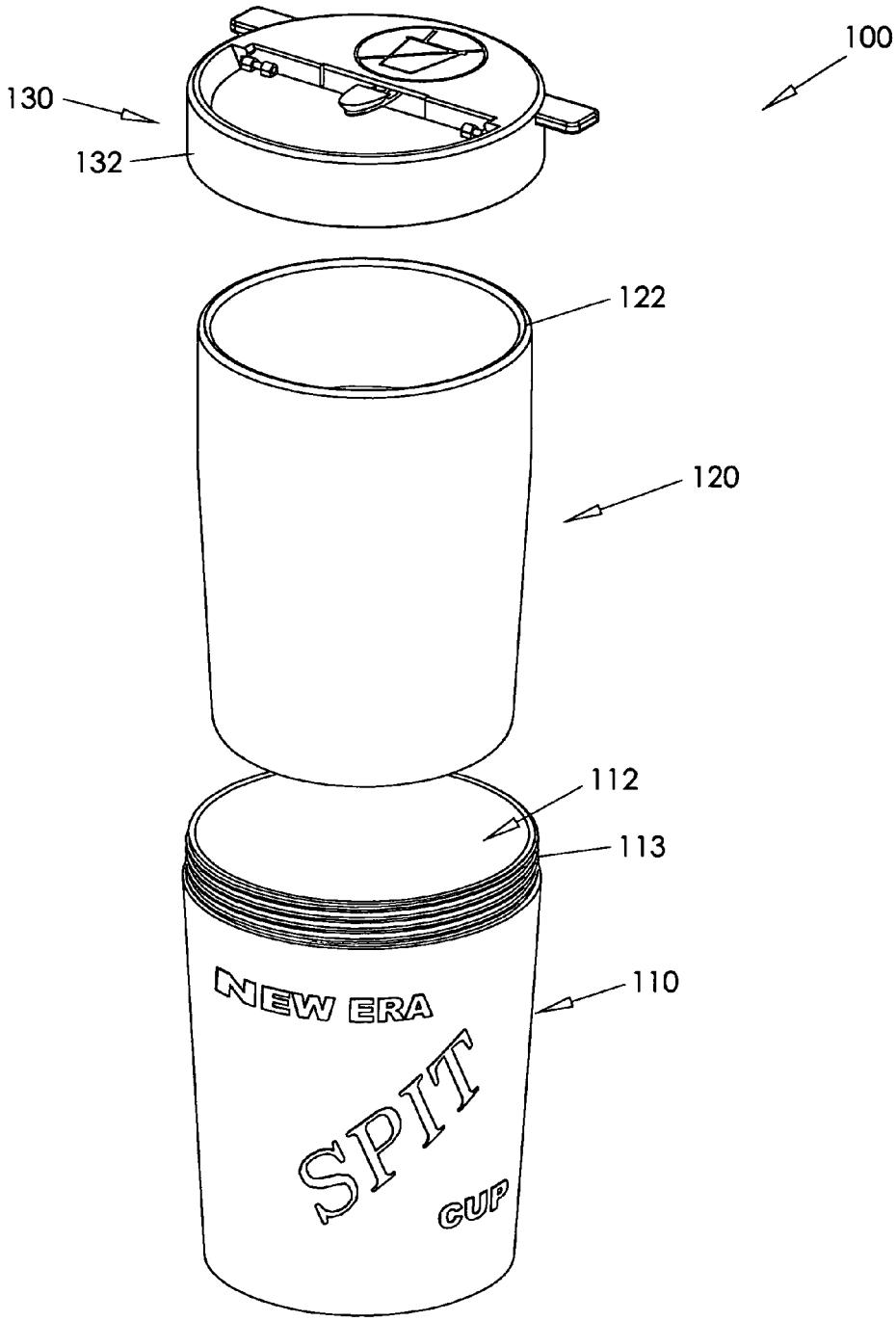
FIG. 2 is an exploded view of the spit cup as in FIG. 1.

The cup housing 110 defines an interior area 112 and may define at least one exterior thread 113, as shown in FIG. 2. The cup housing 110 may be rigid or semi-rigid and may be constructed of various materials, including plastics, metals, composites, foams, etc.

The liner 120 (FIG. 2) may be removably positioned in the interior area 112 to receive a user's spit. The liner 120 may have an upper end 122, and the upper end 122 may be sealed to the lid 130 (e.g., to the stationary portion 132 as discussed below) when the liner 120 is positioned in the interior area 112 and the lid 130 is coupled to the cup housing 110. Sealing the liner 120 to the lid 130 may aid in keeping the contents of the liner 120 (e.g., spit) from entering the area between the cup housing 110 and the liner 120. The liner 120 may be disposable or washable, and may optionally be constructed of a biodegradable and/or recycled material to minimize environmental impacts. It should be understood that a plurality of the liners 120 may be included, and that the plurality of liners 120 may be stored in the interior area 112 or outside the interior area 112.

Figure 1:
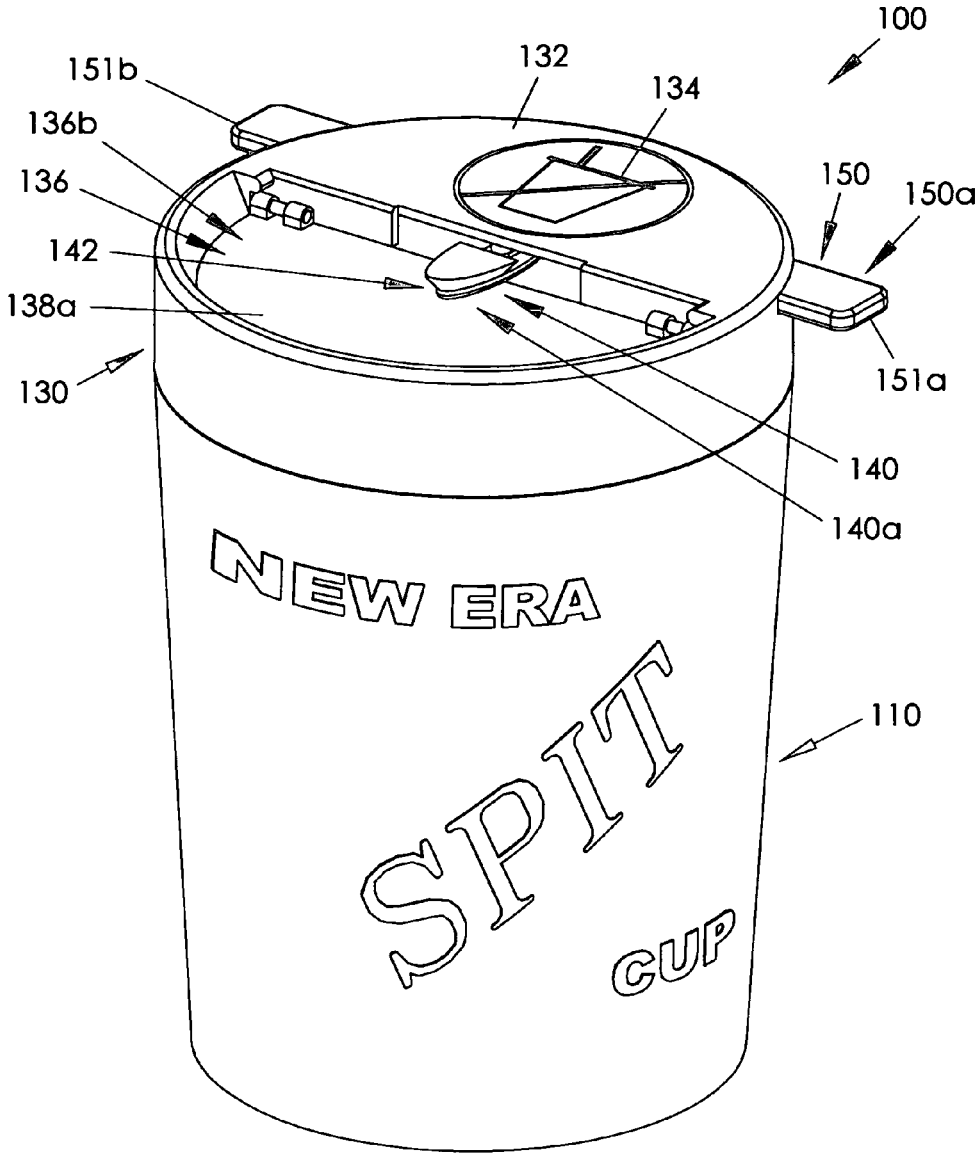
FIG. 1 is a perspective view of a spit cup according to a preferred embodiment of the present invention.

As shown in FIG. 1, the lid 130 may be selectively coupled to the cup housing 110. To couple the lid 130 to the cup housing 110, the lid 130 may for example define at least one interior thread 133 (FIG. 4*b*) that has a configuration complementary to the configuration of the exterior thread 113 defined by the cup housing 110. It should be appreciated that other ways of attaching the lid 130 to the cup housing 110 may alternately be used, such as clamps, friction, quick-snap fasteners, etc.

Figure 3:
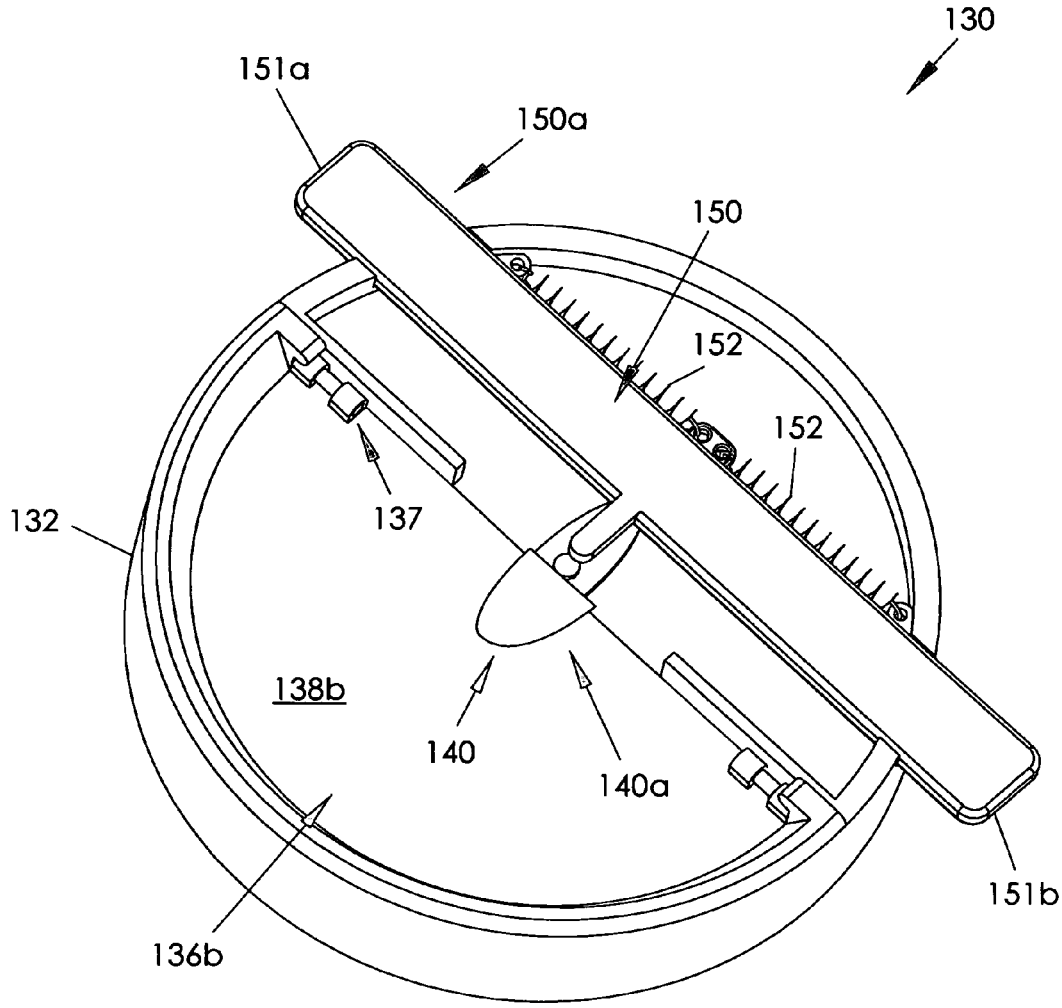
FIG. 3 is a perspective view of a lid of the spit cup as in FIG. 1.
Figure 4A:
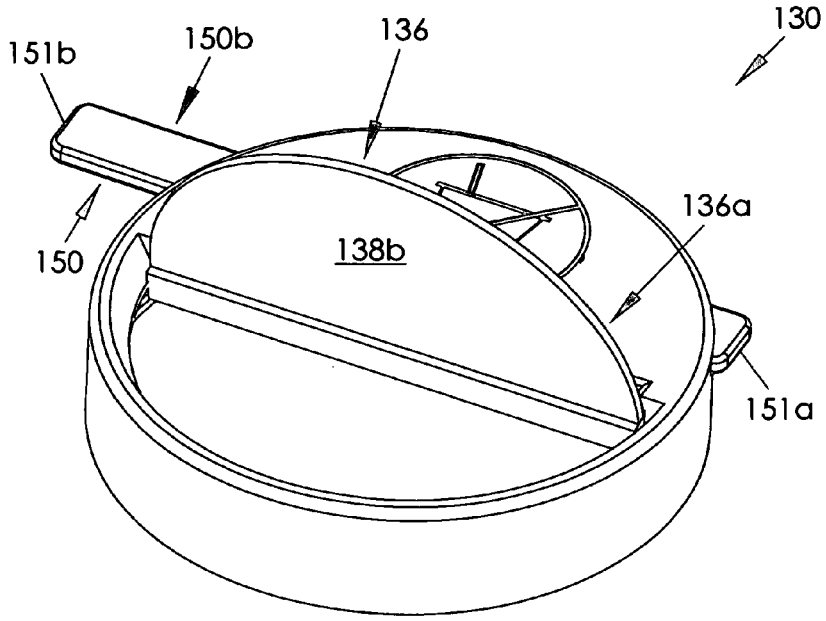
FIG. 4*a* is a perspective view of the lid with a flap in an open configuration.
Figure 4B:
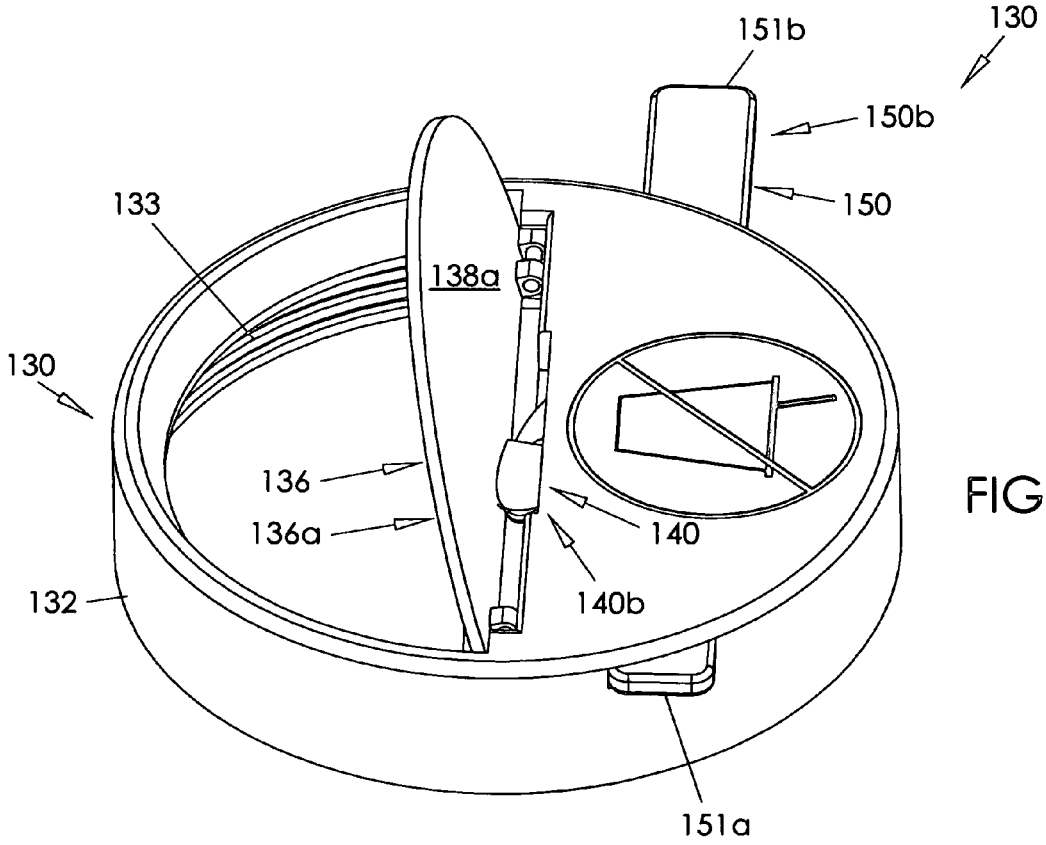
FIG. 4*b* is another perspective view of the lid with the flap in the open configuration.

The lid 130 includes a stationary portion 132 and a flap 136. The flap 136 may have upper and lower faces 138*a*, 138*b*, as shown in FIGS. 4*a* and 4*b*. The flap 136 is operatively coupled (e.g., pivotally coupled) to the stationary portion 132 and is movable between an open position 136*a* (FIGS. 4*a* and 4*b*) providing access to the interior area 112 and the liner 120 and a closed position 136*b* (FIG. 1) preventing access to the interior area 112 and the liner 120. A spring 137 (FIG. 3) may bias the flap 136 toward the open position 136*a*. The stationary portion 132 may include indicia 134 (FIG. 1) indicating that the cup housing 110 does not contain a beverage.

Means for selectively maintaining the flap 136 at the closed position 136*a* may be included. More particularly, the lid 130 may include a catch 140 operatively coupled (e.g., pivotally coupled) to the stationary portion 132 of the lid 130. The catch 140 is movable between a first configuration 140*a* (FIGS. 1 and 3) and a second configuration 140*b* (FIGS. 4*a* and 4*b*). When at the first configuration 140*a*, the catch 140 interacts with the flap 136 and maintains the flap 136 at the closed position 136*b*; when at the second configuration 140*b*, the catch 140 allows the flap 136 to move to the open position 136*a*. The catch 140 may further be movable between the first configuration 140*a* and a third configuration 140*c* (FIG. 5*a*), and the catch 140 may allow the flap 136 to move to the open position 136*a* when at the third configuration 140*c*. When at the first configuration 140*a*, the catch 140 may interact with the upper face 136*a* of the flap 136 (FIG. 1) and/or the lower face 138*b* of the flap 136 (FIG. 3) to maintain the flap 136 at the closed position 136*b*. As best shown in FIG. 1, the catch 140 may have a wedge configuration 142 for facilitating interaction between the catch 140 and the flap 136 to move the flap 136 between the open and closed positions 136*a*, 136*b*. In other words, the wedge configuration 142 may allow the catch 140 to gradually move the flap 136 to the closed position 136*b* and gradually allow the flap 136 to be moved to the open position 136*a*.

Figure 5A:
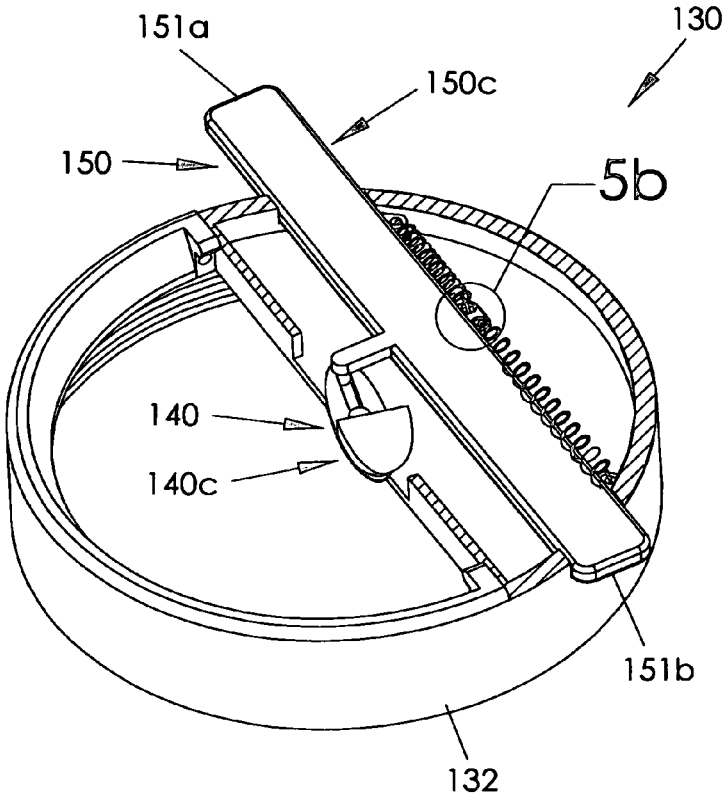
FIG. 5*a* is a perspective view of the lid with the stationary portion and flap removed to illustrate the slider and spring interaction.
Figure 5B:
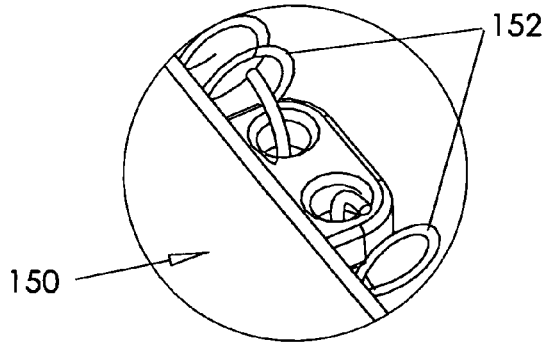
FIG. 5*b* is an isolated view on an enlarged scale of a portion of the slider and springs taken from FIG. 5*a*.

Means for moving the catch 140 between the first and second configurations 140*a*, 140*b* may be included. More particularly, the lid 130 may include a slider 150 operatively coupled to the catch 140. The slider may have a first end 151*a* and/or a second end 151*b* extending beyond the stationary portion 132 of the lid 130. The slider 150 is biased to a ready configuration 150*a* (FIGS. 1 and 3) by at least one spring 152 and is movable between the ready configuration 150*a* and at least one use configuration 150*b* (FIGS. 4*a* and 4*b*). As shown in FIG. 5*a*, the slider 150 may be further movable to another use configuration 150*c*. If movable to multiple use configurations, the slider 150 may be biased to the ready configuration 150*a* by a plurality of the springs 152 (FIGS. 5*a* and 5*b*). When at the ready configuration 150*a*, the slider 150 may maintain the catch 140 at the first configuration 140*a*, as shown in FIGS. 1 and 3.

In use, the liner 120 may be placed in the housing 110, and the lid 130 may be coupled to the housing 110 such as through the threaded connection discussed above. As shown in FIGS. 1 and 3, the springs 152 may bias the slider 150 to the ready configuration 150*a*, causing the catch 140 to remain at the first configuration 140, which in turn maintains the flap 136 at the closed position 136*b* as discussed above. To move the flap 136 to the open position 136*a*, a user may apply a force to either end 151*a*, 151*b* of the slider 150.

Applying a force to the first end 151*a* of the slider 150 may overcome the force of the springs 152 and move the slider from the ready configuration 150*a* to the first use configuration 150*b* (FIGS. 4*a* and 4*b*). When at the first use configuration 150*b*, the slider 150 may maintain the catch 140 at the second configuration 140*b*, allowing the spring 137 to move the flap 136 to the open position 136*a* as discussed above. Alternately, applying a force to the second end 151*b* of the slider 150 may overcome the force of the springs 152 and move the slider from the ready configuration 150*a* to the second use configuration 150*c* (FIG. 5*a*). When at the second use configuration 150*c*, the slider 150 may maintain the catch 140 at the third configuration 140*c*, allowing the spring 137 to move the flap 136 to the open position 136*a* as discussed above.

To return the flap 136 to the closed position 136*b*, the force may be removed from the appropriate end 151*a*, 151*b* of the slider 150, allowing the springs 152 to return the slider 150 to the ready configuration 150*a*. In moving to the ready configuration 150*a*, the slider 150 may return the catch 140 to the first configuration 140, causing the catch 140 to interact with the flap 136 as discussed above and return the flap 136 to the closed position 136*b*. With the flap 136 in the closed position, any odor within the interior space is substantially contained therein.

It is understood that while certain forms of this invention have been illustrated and described, it is not limited thereto except insofar as such limitations are included in the following claims and allowable functional equivalents thereof.

The invention claimed is:

1. A spittoon, comprising:

a cup housing defining an interior area;

a liner removably positioned in said interior area; and a lid selectively coupled to said cup housing, said lid having:

a stationary portion;

a flap operatively coupled to said stationary portion and being movable between an open position providing access to said liner and a closed position preventing access to said liner;

a spring biasing said flap toward said open position;

a catch operatively coupled to said stationary portion and being movable between a first configuration in which said catch interacts with said flap and maintains said flap at said closed position and a second configuration in which said catch allows said flap to move to said open position, wherein said catch is pivotally coupled to said lid stationary portion, and said catch is further movable between said first configuration and a third configuration in which said catch allows said flap to move to said open position; and a slider having first and second ends extending beyond said stationary portion, said slider being operatively coupled to said catch; said slider is biased to a ready configuration by a plurality of springs; said slider is movable between said ready configuration and two use configurations; applying a force to said first end of said slider moves said slider from said ready configuration to a first said use configuration; applying a force to said second end of said slider moves said slider from said ready configuration to a second said use configuration; said slider maintains said catch at said first configuration when said slider is at said ready configuration; said slider maintains said catch at said second configuration when said slider is at said first use configuration; and said slider maintains said catch at said second use configuration.

2. The spit cup as in claim 1, wherein said catch has a wedge configuration for facilitating interaction between said catch and said flap to move said flap between said open and closed positions.

3. The spit cup as in claim 2, wherein:

said liner has an upper end; and said liner upper end is sealed to said lid stationary portion when said liner is positioned in said interior area and said lid is coupled to said cup housing.

4. The spit cup as in claim 3, wherein:

said flap has upper and lower faces; and said catch interacts with said upper face and said lower face when said catch is at said first configuration.

5. The spit cup as in claim 1, wherein:
said liner has an upper end; and
said liner upper end is sealed to said lid stationary portion when said liner is positioned in said interior area and said lid is coupled to said cup housing.

6. The spit cup as in claim 1, wherein:
said liner is disposable; and
said liner is biodegradable.

7. The spit cup as in claim 1, wherein:
said cup housing defines at least one exterior thread; and
said lid defines at least one interior thread having a configuration complementary to a configuration of said at least one exterior thread for selectively coupling said lid to said cup housing.

8. The spit cup as in claim 1, wherein:
said flap has upper and lower faces; and
said catch interacts with at least one of said upper face and said lower face when said catch is at said first configuration.

9. The spit cup as in claim 1, wherein:
said flap has upper and lower faces; and
said catch interacts with said upper face and said lower face when said catch is at said first configuration.

10. The spit cup as in claim 1, wherein said stationary portion includes indicia indicating that said cup housing does not contain a beverage.

11. A spittoon, comprising:
a cup housing defining an interior area;
a plurality of disposable liners, at least one said disposable liner being removably positioned in said interior area to receive a user's spit; and
a lid selectively coupled to said cup housing, said lid having:
a stationary portion;
a flap pivotally coupled to said stationary portion and being movable between an open position providing access to said interior area and a closed position preventing access to said interior area, wherein said flap has upper and lower faces;
a spring biasing said flap toward said open position;
means for selectively maintaining said flap at said closed position, wherein said means for selectively maintaining said flap at said closed position includes a catch operatively coupled to said stationary portion and being movable between a first configuration and a second configuration, and said catch is further movable between said first configuration and a third configuration in which said catch allows said flap to move to said open position, wherein said catch interacts with said upper face and said lower face when said catch is at said first configuration; and
a slider having first and second ends extending beyond said stationary portion, said slider being operatively coupled to said catch; said slider is biased to a ready configuration by a plurality of springs; said slider is movable between said ready configuration and two use configurations; applying a force to said first end of said slider moves said slider from said ready configuration to a first said use configuration; applying a force to said second end of said slider moves said slider from said ready configuration to a second said use configuration; said slider maintains said catch at said first configuration when said slider is at said ready configuration; said slider maintains said catch at said second configuration when said slider is at said first use configuration; and said slider maintains said catch at said second use configuration.

12. The spit cup as in claim 11, wherein said means for selectively maintaining said flap at said closed position includes a catch operatively coupled to said stationary portion and being movable between a first configuration in which said catch interacts with said flap and maintains said flap at said closed position and a second configuration in which said catch allows said flap to move to said open position.

13. A spittoon, comprising:
a cup housing defining an interior area;
a liner removably positioned in said interior area; and
a lid selectively coupled to said cup housing, said lid having:
a stationary portion;
a flap operatively coupled to said stationary portion and being movable between an open position providing access to said liner and a closed position preventing access to said liner, wherein said flap has upper and lower faces;
a spring biasing said flap toward said open position;
a catch operatively coupled to said stationary portion and being movable between a first configuration in which said catch interacts with said flap and maintains said flap at said closed position and a second configuration in which said catch allows said flap to move to said open position, wherein said catch is pivotally coupled to said lid stationary portion, and said catch is further movable between said first configuration and a third configuration in which said catch allows said flap to move to said open position, wherein said catch interacts with at least one of said upper face and said lower face when said catch is at said first configuration; and
means for moving said catch between said first and second configurations, wherein said means for moving said catch between said first and second configurations includes a slider operatively coupled to said catch, said slider having first and second ends extending beyond said stationary portion, said slider being operatively coupled to said catch; said slider is biased to a ready configuration by a plurality of springs; said slider is movable between said ready configuration and two use configurations; applying a force to said first end of said slider moves said slider from said ready configuration to a first said use configuration; applying a force to said second end of said slider moves said slider from said ready configuration to a second said use configuration; said slider maintains said catch at said first configuration when said slider is at said ready configuration; said slider maintains said catch at said second configuration when said slider is at said first use configuration; and said slider maintains said catch at said second use configuration.

14. The spit cup as in claim 13, wherein:
said flap has upper and lower faces; and
said catch interacts with said upper face and said lower face when said catch is at said first configuration.

15. The spit cup as in claim 13, wherein said catch has a wedge configuration for facilitating interaction between said catch and said flap to move said flap between said open and closed positions.

* * * * *